United States Patent [19]

Scofield

[11] 4,137,656

[45] Feb. 6, 1979

[54] METHOD AND APPARATUS FOR TRANSPORTING CANVAS MURALS

[76] Inventor: John E. Scofield, Schooner Cove, Mariners La., Stamford, Conn. 06902

[21] Appl. No.: 885,795

[22] Filed: Mar. 13, 1978

[51] Int. Cl.[2] ..... D06C 3/08

[52] U.S. Cl. ..... 38/102.91; 160/378

[58] Field of Search ..... 38/102, 102.1, 102.8, 38/102.91; 140/108; 160/378, 395, 402

[56] References Cited

U.S. PATENT DOCUMENTS

| | | | |
|---|---|---|---|
| 2,704,906 | 3/1955 | Amado | 38/102.91 X |
| 3,908,293 | 9/1975 | Newman | 38/102.91 |
| 3,987,835 | 10/1976 | Bloomfield | 160/395 X |
| 4,006,771 | 2/1977 | Spurkel | 160/378 |
| 4,085,789 | 4/1978 | Steiner et al. | 160/378 X |

*Primary Examiner*—Louis Rimrodt

*Attorney, Agent, or Firm*—Kane, Dalsimer, Kane, Sullivan and Kurucz

[57] ABSTRACT

A portable frame for holding and transporting fabric-based murals. The frame comprises tubular members joined together and conforming to the shape of the canvas to be mounted thereon. The canvas is folded over to the back side of the frame, and pipe-like battens are secured to the ends of the canvas. Cords attached to the battens are pulled to insure a uniform, wrinkle-free mounting of the canvas.

10 Claims, 6 Drawing Figures

FIG. 1
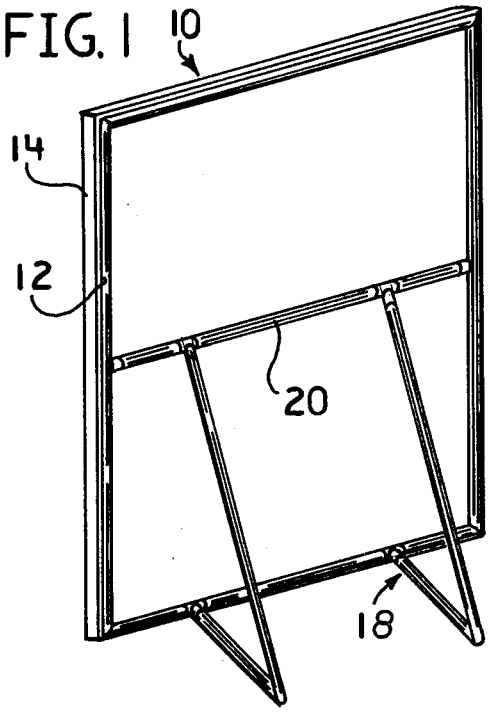
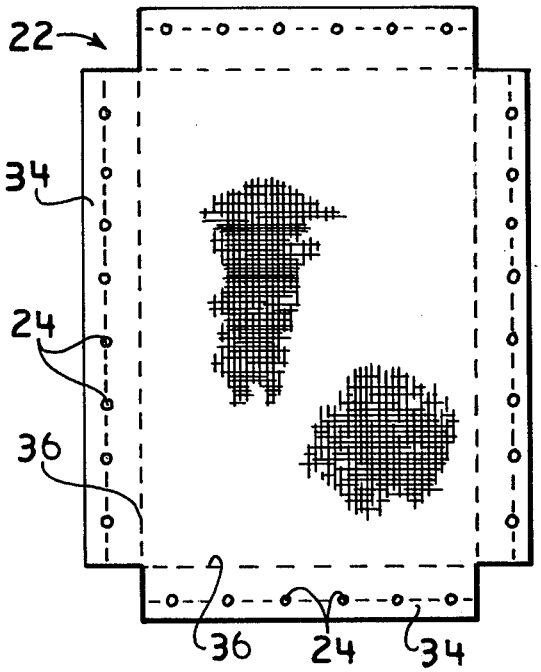
FIG. 2
FIG. 4
FIG. 3
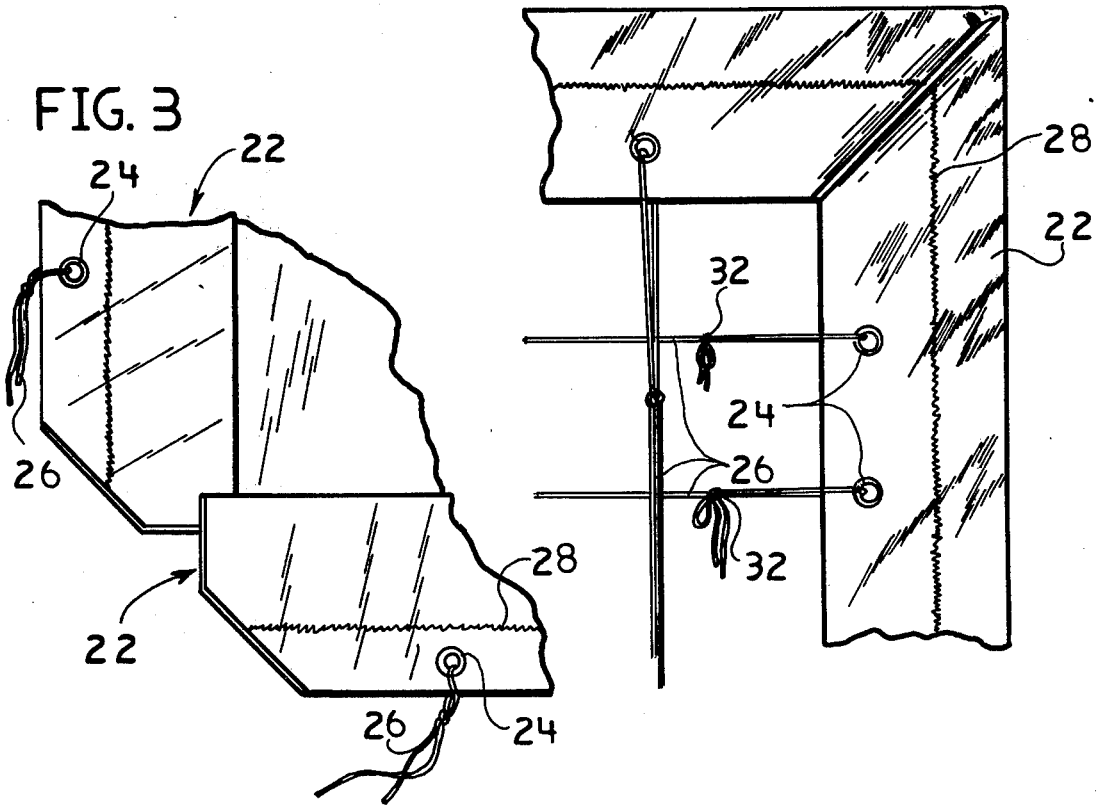

METHOD AND APPARATUS FOR TRANSPORTING CANVAS MURALS

BACKGROUND OF THE INVENTION

The field of the invention concerns frames for the mounting of fabric based murals such that they may be mounted easily without bulges or wrinkles.

A number of different frame designs have been promulated in the past. U.S. Pat. Nos. 2,456,225; 2,455,640; 3,950,869; 3,978,905; and 3,553,862 are examples of such frames.

Until the present, a frame has not been designed which combines simplicity in construction, ease of application of the canvas, and a simple means of adjustment to provide a wrinkle-free surface.

SUMMARY OF THE INVENTION

The invention is of a frame for mounting and transporting canvas murals.

It is an object of the invention to provide a frame which is simple and economical to manufacture.

Another object of the invention is to provide a frame of sufficient strength for the accommodation of very large canvasses.

Still another object of the invention is to provide a frame upon which a canvas can be mounted quickly without damage, perforation, or subsequent deterioration.

Still other object of the invention is to provide means by which a wrinkle can be made taut with a simple and quick local adjustment.

In achieving these and other objectives, a frame is provided which comprises tubular members joined together and defining a geometric shape generally conforming to the shape of the canvas to be mounted thereon. The tubular frame members are preferred over, for example, square members for their omni-directional strength, particularly for very large canvasses. The tubular portions of the frame may be secured to flat bar members which obviate lumps or bulges in the canvas. The flat surfaces may be padded to isolate the canvas from direct contact with the frame.

The dimensions of the overall frame are slightly less than that of the canvas so that the periphery of the canvas can be folded over to the back-side of the frame. Pipe-like battens are secured to the folded-over peripheral portions of the canvas. Preferably the battens are either hemmed into the canvas, or the canvass may be glued instead of stitching. Grommets are utilized in the canvass such that cords may be employed around the battens for tightening the canvas. The battens provide a uniform pull on the canvas, thereby resisting wrinkles in the canvas mural. The batten system, with cords drawn tight, also functions to rigidity the frame.

Triangular rear legs may also be provided on the frame to support it in an upright position. The frame is preferably of a metallic material such as aluminum. Aluminum has no adverse effect on canvass as wood may over a period of time, and will not rot or warp like wood.

BRIEF DESCRIPTION OF THE DRAWINGS

FIG. 1 is a perspective view of the rear side of the frame prior to securement of a canvas.

FIG. 2 is a front view of the canvas which is adapted for securement to the frame.

FIG. 3 is a plan view of a corner of the canvas before it is mounted.

FIG. 4 is a plan view of the rear side of the canvas when mounted to the frame.

DETAILED DESCRIPTION OF THE INVENTION

Figure 5:
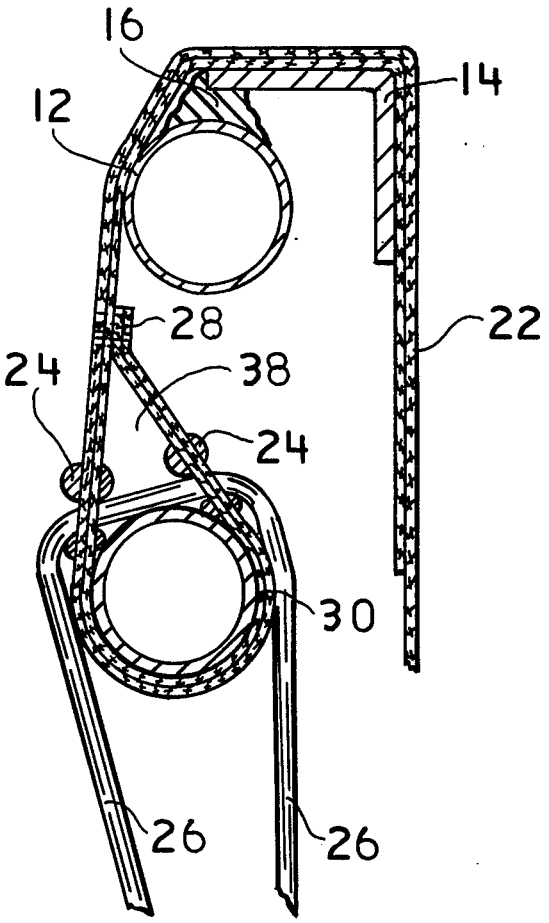
FIG. 5 is a sectional side view of the frame with the canvas mounted theron.

FIG. 1 illustrates the novel frame 10 prior to application of a canvas mural. The frame comprises L-shaped members 14 which are welded to tubular portions 12. Triangular shaped legs 18 may be secured to the frame via cross-bar 20 which spans the width of the frame. The frame as herein described is constructed from aluminum or other suitable material. It is desirable to use a substance which combines strength without either deteriorating itself or causing deterioration of the attached canvas. For these reasons, aluminum is desirable over, for example, wood. The strength of the frame is particularly important when large canvasses are to be secured.

FIG. 2 shows a canvass 22 which is to be secured to the frame 10. Grommets 24 are provided about its peripheral edges, and dotted line 36 illustrates where the canvass is to be folded back around the frame to provide a square canvas. Dotted line 34, which is colinear with the line of grommets 24, and the outer periphery of the canvass define a portion of a pocket in which a batten is inserted for tightening of the canvass.

FIG. 3 shows a corner of the canvas before it is applied to the frame. The rear side is shown in the illustration, and both the canvas 22 and the hem 28 sewn therein are visible. Cords 26 have been looped through the grommets 24. The corner has also been cut so that it is not square as shown in FIG. 2.

When the canvass as shown in FIG. 3 is folded along line 36 back around the frame 10, the corner of the canvas appears as shown in FIG. 4. The cords 26 appear taut in this illustration as the canvass is attached to the frame.

FIG. 5 is a sectional view of the frame 10 with the attached canvas 22, and clearly shows the relationship of the features of the invention. The tubular members 12 of the frame are attached to L-shaped flat bar member 14 by a weld 16. The flat surface of the L-shaped member obviates lumps and bulges in the canvas.

Stitching 28 defines a pocket 38 within the canvass, into which a batten 30 may be inserted. Cords 26 are looped through grommets 24 for applying tension to the batten. The batten assures a steady and uniform pull on the canvass as the cords are tightened. The same tubular aluminum which is used in the construction of the frame may also be used for the battens. It may be of any suitable diameter, but is preferably of the same size as the tubular portions 12 or slightly smaller. Other materials may alternatively be employed, but aluminum is preferred for the same reasons as stated for the frame itself.

To prevent direct contact between the canvas and the frame, particularly the flat surfaces, padding (not shown) may be provided.

Figure 6:
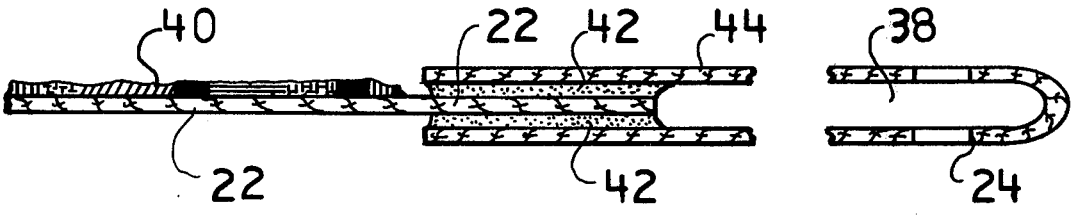
FIG. 6 shows an alternative means of securing the peripheral edges of the canvas.

FIG. 6 illustrates an alternative means for forming the pocket 38. Instead of stitching which is shown in FIGS. 3–5, glue 42 is applied to both sides of the peripheral edges of the canvas 20. A second piece of canvas 44 is folded over and both of its ends are applied to the glued surface. Care should be taken so that the glue does not touch the painting 40.

"Elvace" white glue has been found to be suitable for this application, although other adhesives could also be used. It is thinned slightly with water, and applied a short distance from the edges of the painting 40. In this application, the glue was applied about one quarter inch from these edges for a distance of about two inches. The second piece of canvass 44 is then folded and positioned, and the resulting "sandwich" is pressed with a cold flat iron. The structure obtained is shown in FIG. 6.

The frame herein described is both sturdy and lightweight, enabling a canvass mural to be safely and easily transported. The canvass is secured to the frame by folding its peripheral edges over the frame, the frame being of smaller dimensions than the canvass to allow such folding. Battens 30 are provided in the pocket portions 38 of the canvass, and cords 26 looped through grommets 24 enable one to apply tension to the battens. The cords are looped through grommets on opposite sides of the frame to pull the canvas together, and the vertical cords cross the horizontal ones at the rear of the structure (Note FIG. 4). FIG. 4 shows a "rolling hitch" knot 32 used as a tightening adjustment. Alternatively, tube type "jam" cleats (not shown) could be used to tighten and adjust the canvass. Other tightening means would also probably be suitable.

The above description and drawings disclose preferred embodiments of the invention which should not be construed as limiting in any manner. Alternative embodiments may also be designed by those skilled in the art which would fall within the spirit of the invention. The scope of the invention should accordingly be determined by the appended claims.

What is claimed is:

1. An assembly for mounting fabric based murals, which comprises:

a tubular frame having the general configuration of the mural and a size slightly smaller than the dimensions of the mural;

a flat bar member mounted on the frame, said flat bar member providing a flat surface against which the mural may be applied;

pockets provided in the peripheral edges of the mural, said pockets being folded over the frame;

battens located within said pockets; and cord means for applying tension to said battens, thereby removing wrinkles from the mural.

2. An assembly as described in claim 1 wherein the frame is aluminum.

3. An assembly as described in claim 1 wherein grommets are provided in the pockets, the cord means extending through the grommets and applying tension to the battens.

4. An assembly as described in claim 1 wherein the flat bar member is L-shaped, and wherein the mural may be applied against both portions of the "L".

5. An assembly as described in claim 1 wherein the mural and frame are both substantially rectangular, the cord means extending from battens on one side of the frame to the battens located on the opposite side of the frame and crossing the frame in substantially horizontal and vertical directions, whereby when tension is applied by the cord means, battens on both sides of the frame tend to remove wrinkles from the mural.

6. An assembly as described in claim 1 wherein the pockets are formed by folding over the peripheral edges of the mural and stitching them to said mural.

7. An assembly as described in claim 1 wherein the pockets are formed by glueing the opposite edges of a folded piece of fabric to the mural.

8. A method for mounting a fabric based mural to a frame having the general configuration of the mural and a size slightly smaller than the dimensions of said mural, said frame being of tubular construction and having a flat bar member mounted thereon against which the mural may be applied, comprising providing a mural with pockets located along its peripheral edges said pockets having battens therin and cord means for applying tension to said battens;

folding the peripheral edges of the mural over the frame such that the pockets are also folded over the frame and applying tension to the battens by the tightening of the cord means such that the mural is mounted in a uniform, wrinkle-free manner.

9. A method as described in claim 8 in which the frame is rectangular in shape, wherein while applying tension to a batten on one side of the frame by tightening of a cord means, tension is simultaneously being applied by the cord means to a batten on the other side of the frame.

10. A method as described in claim 8 wherein the applying of tension to the battens is accomplished by tightening cord means which are looped through gromments within the pockets.

* * * * *